US005491982A

United States Patent [19]

Gowens

[11] Patent Number: 5,491,982

[45] Date of Patent: Feb. 20, 1996

[54] CHILLER BYPASS

[75] Inventor: Patrick A. Gowens, Carol Stream, Ill.

[73] Assignee: AEC, Inc., Wood Dale, Ill.

[21] Appl. No.: 330,022

[22] Filed: Oct. 27, 1994

[51] Int. Cl.[6] ..... F25D 17/02

[52] U.S. Cl. ..... 62/434; 62/436; 165/38

[58] Field of Search ..... 62/185, 430, 434, 62/435, 436; 165/38; 137/599.1

[56] References Cited

U.S. PATENT DOCUMENTS

| | | | |
|---|---|---|---|
| 2,158,716 | 5/1939 | Bergdoll . | |
| 2,779,171 | 1/1957 | Lindenblad | 62/434 X |
| 2,873,758 | 2/1959 | Nielsen | 137/599.1 X |
| 3,213,930 | 10/1965 | Robinson | 165/38 |
| 3,216,215 | 11/1965 | Schuett | 62/435 X |
| 4,415,847 | 11/1983 | Galloway . | |
| 4,850,201 | 7/1989 | Oswalt et al. . | |
| 4,967,832 | 11/1990 | Porter | 62/434 X |
| 5,076,068 | 12/1991 | Mikhail . | |
| 5,117,866 | 6/1992 | Nicholas . | |
| 5,137,079 | 8/1992 | Anderson | 165/38 |

OTHER PUBLICATIONS

AEC, Inc. Bulletin AE2–115.1 (1994).

*Primary Examiner*—William E. Tapolcai

*Attorney, Agent, or Firm*—Dorn, McEachran, Jambor & Keating

[57] ABSTRACT

An improvement in a water chiller of the kind used for industrial processes such as electrical discharge machining (EDM). The chiller includes a reservoir for water (frequently de-ionized water), an evaporator, refrigerating apparatus such as a condenser and a compressor, and a pump; there is a supply line connection to an electrical discharge machining apparatus or other industrial process apparatus, and a return line connection. The pressure in the return line is usually lower than the pressure in the supply line. The improvement includes a fitting connected in series in the supply line and a bypass line connected to that fitting to afford a bypass flow of water in parallel with the process apparatus. A flow-limiting orifice member in series in the bypass line limits the bypass flow to a predetermined rate; the rate may be determined by the pressure differential between the supply and return lines. All fittings are formed of non-ionizing resins such as nylon; the orifice member is stainless steel. There is no valve in the bypass.

9 Claims, 2 Drawing Sheets

CHILLER BYPASS

BACKGROUND OF THE INVENTION

There are a number of industrial processes that require a supply of chilled water or other liquid coolant that maintains the industrial process within predetermined thermal limits. The water chiller is often a stand-alone device, complete in and of itself, with appropriate supply and return connections for conduits connected to the industrial process. The industrial process may be an injection molding machine for molding plastic devices; a number of other industrial processes have similar requirements. As with any industrial equipment, cost may be an important factor for the chiller.

In recent years, particularly with thee advent of electrical discharge machining (EDM) equipment, it has been necessary to provide de-ionized water as the liquid coolant. The usual electrical conductivity of water that is not thoroughly de-ionized cannot be tolerated. Conventional metal fittings are undesirable because continued use of fittings of this kind, in the chiller, may lead to degradation of the initially de-ionized water to the extent that ineffective operation may result. As a consequence, the bypass conduit in the chiller has frequently been made of stainless steel. There is usually a valve in the bypass line; the result is that the complete bypass, which is a necessity in order to avoid freeze-up and/or overheating of the chilling apparatus, and to avoid pump damage, becomes unduly expensive. This is particularly true in instances in which the bypass and other internal coolant circuits in the chiller are formed of stainless steel.

SUMMARY OF THE INVENTION

It is a principal object of the present invention, therefore, to provide an improvement in a liquid coolant chiller, particularly for industrial processing, that minimizes the use of stainless steel in the chiller and that has no valve in the bypass line of the chiller.

A further object of the invention is to eliminate potential error on the part of an operator, as may occur when a bypass valve in a chiller is opened too much or closed down too tight so that the bypass flow is incorrect.

Another object of the invention is to provide a new and improved bypass construction for an industrial water chiller or other liquid coolant chiller that is simple and economical in construction yet has an operating life of indefinite duration.

Accordingly, the invention relates to an improvement in a chiller for a liquid coolant, usually water. The chiller comprises a reservoir for storing a liquid coolant and chilling apparatus, including an evaporator, connected to the reservoir. There is a supply line connection connectable to a process apparatus to supply chilled liquid coolant to the process apparatus, and a return line connection connectable to the process apparatus for returning liquid coolant to the chiller. A bypass line affords a bypass flow of liquid coolant in the chiller, in parallel with the process apparatus. The improvement comprises a first fitting in series in the supply line of the chiller, which fitting connects the supply line to the bypass line. A flow-limiting orifice member is interposed in series in the bypass line to limit the bypass flow to a given flow rate. There is no valve in the bypass line.

DESCRIPTION OF THE PREFERRED EMBODIMENTS

Figure 1:
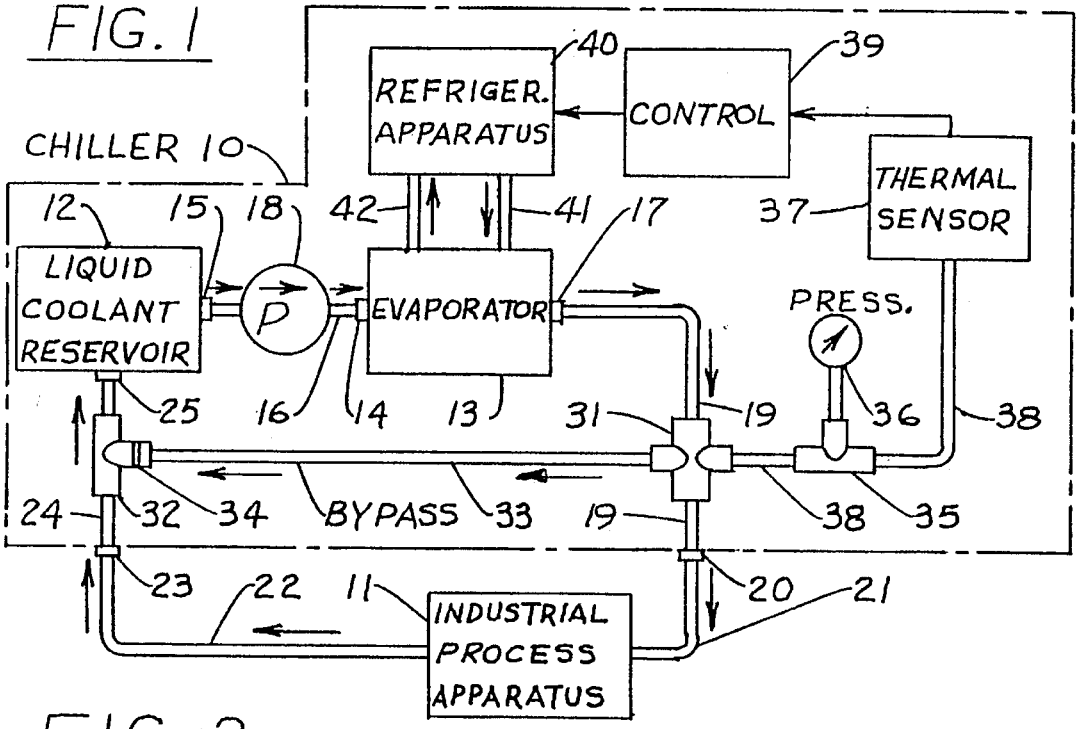
FIG. 1 is a schematic diagram of a water chiller connected to an industrial process, the water chiller incorporating the improvement of the present invention.

FIG. 1 illustrates a water chiller 10 or other like chiller for a liquid coolant; chiller 10 incorporates the improvement of the present invention. Chiller 10 includes a liquid coolant reservoir 12. In most instances, the liquid coolant is water and frequently is de-ionized water for use in EDM equipment, in lasers, and in other industrial processes in which the coolant must be non-conductive and/or very clean. Chiller 10 further includes an evaporator 13 having an inlet 14 connected by a conduit 16 to the outlet 15 of tank 12. A pump 18 is interposed in series in conduit 16. The outlet 17 of evaporator 13 is connected to a supply line 19 having a connection 20 that is connectable to a further conduit 21 extending to an industrial process apparatus 11. The industrial process apparatus 11 may comprise EDM equipment, laser apparatus, or an injection molding machine. Alternatively, apparatus 11 could include any industrial processing apparatus that requires a supply of chilled water, particularly de-ionized water, or some other liquid coolant. Evaporator 13 is connected, as by refrigerant lines 41 and 42, to a refrigerating apparatus 40 that may include a condenser and a compressor. A control 39 is provided for refrigerating apparatus 40.

There is a coolant return line 22 from process apparatus 11 to a connection 23 that is a part of chiller 10. Within chiller 10, a coolant return line 24 extends from connection 23 to the inlet 25 of reservoir 12, thus completing the coolant loop. No pump has been shown in the return line 22–24. It will be appreciated that there may be a pump in industrial process apparatus 11 or, in some instances, there may be no need for a further pump. The pressure of the liquid flowing in return line 24 is usually below the supply pressure in line 19. In some systems the return line pressure may be near or at atmospheric pressure.

There is a first fitting 31, a special tee having four ports, incorporated in series in the coolant supply line 19 of chiller 10. Fitting 31 is connected by a bypass line 33 to a second special tee fitting 32 that is incorporated in series in return line 24 in chiller 10. An orifice member 34 is included in series with bypass line 33; it is shown as being mounted in fitting 32. There is an additional conduit 38 in chiller 10 that connects fitting 31 to a thermal sensor 37. Sensor 37 is electrically connected to the control 39 for refrigerating apparatus 40, which is usually a microprocessor control. A tee fitting 35 may be incorporated in series in line 38 to connect that line to a pressure gauge 36.

As thus far described, chiller 10 is generally conventional except that there would ordinarily be a control valve in series in bypass line 33. Thus, water or other liquid coolant from reservoir 12 is cooled in evaporator 13; evaporator 13 is refrigerated by virtue of its connections to apparatus 40. From evaporator 13 the water coolant flows, under the pressure supplied by pump 18, through supply line 19 and external conduit 21 to the industrial process apparatus 11. The return path for the coolant water proceeds through conduits 22 and 24 to the inlet 25 of reservoir 12. A bypass flow of coolant is maintained, in parallel with process apparatus 11 through line 33. The bypass flow prevents freeze-up of evaporator 13, overheating of pump 18, or other damage that might otherwise occur within chiller 10.

In chiller 10 the only regulation of flow in bypass line 33 is provided by orifice member 34. The flow rate in bypass conduit 33 can vary to some extent; the flow through orifice 34 is determined by the pressure differential between supply line 19 and return line 24. When the flow of coolant to process apparatus 11 is at a maximum that pressure differential is a minimum. In these circumstances, the flow in bypass line 33 is maintained at a low rate. On the other hand, when the coolant demand of apparatus 11 is at a minimum the pressure differential between lines 19 and 24 is at a maximum. As a consequence, bypass flow is maximized. For both situations, evaporator 13 and pump 18 are effectively protected. Fluctuations in pressure can be determined by the operator by observation of pressure gauge 36. Variations in temperature for the coolant flow are sensed by thermal sensor 37 and are utilized to control operation of refrigerating apparatus 40. The chiller control 39 may be a part of chiller 10 or may be part of a separate control system.

For an orifice member 34 with an orifice having a diameter of about 0.106 inch (0.27 cm) and a cross-sectional area of about 0.009 $in^2$ (0.06 $cm^2$), the flow rates are as shown in Table A.

TABLE A

| Differential Pressure (pounds/square inch) | Bypass Flow Rate (gallons/minute) |
|---|---|
| 20 | 1.1 |
| 30 | 1.3 |
| 40 | 1.5 |
| 50 | 1.8 |

Figure 2:
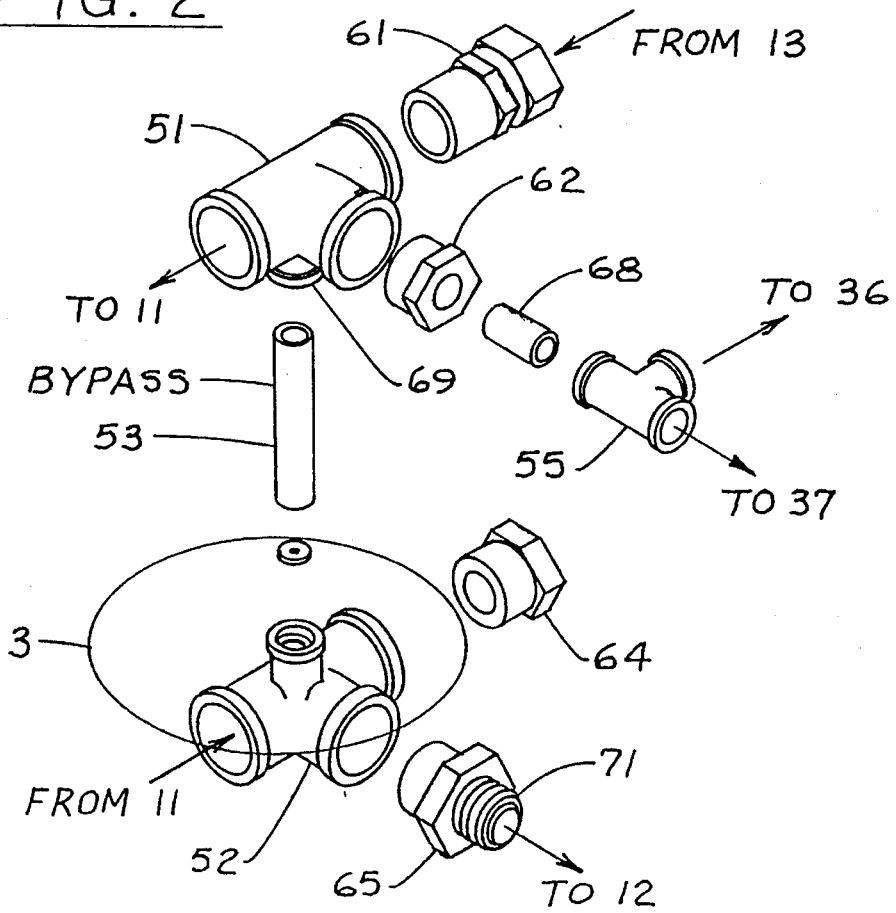
FIG. 2 is an exploded view of principal components for the bypass line connections in the water chiller of FIG. 1.

FIG. 2 affords an exploded illustration, on an enlarged scale, of typical apparatus that may be utilized to implement the improved bypass construction for chiller 10 of FIG. 1. The equipment shown in FIG. 2 begins with a stainless steel fitting 61 that connects to a first special tee fitting 51 in the supply line that leads to process 11. A molded nylon bushing 62 fits into the leg of tee fitting 51 and connects that fitting to a line 68 that is a part of line 38 (FIG. 1). As illustrated, line 68 may comprise a relatively short tube or nipple of plastic tubing. A non-ionizing resin should be used for this tubing. Polyvinyl chloride (PVC) is appropriate. Nipple 68 connects to a small tee 55 to afford connections to pressure gauge 36 and to thermal sensor 37.

Figure 3:
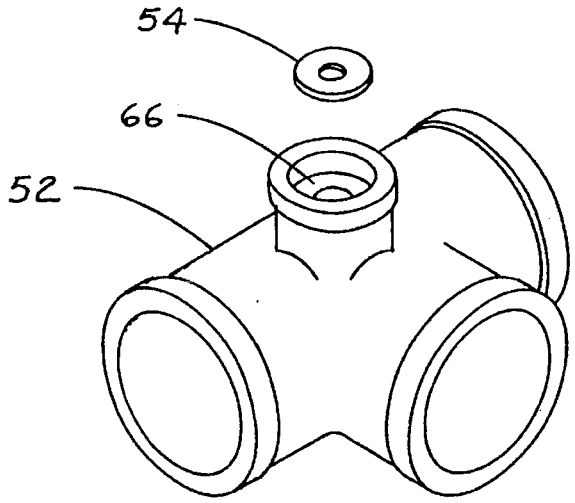
FIG. 3 is a detailed view, on an enlarged scale, of that portion of FIG. 2 enclosed within the circle 3.

The first tee fitting 51 in the apparatus of FIG. 2 has a short connection 69 that connects to one end of a bypass nipple or tube 53 that is a part of bypass line 33, FIG. 1. An orifice member 54 is included in the apparatus at the lower end of tubing 53. As shown in FIG. 3, orifice member 54 is seated in a seat 66 in the return tee fitting 52. Fitting 52 is preferably connected in series in the return line in chiller 10, affording a connection from industrial process 11 to the chiller reservoir or tank 12 (FIG. 1). In this particular embodiment of the invention (FIGS. 2 and 3) one end of fitting 52 is closed by a plug 64. The outlet from the fitting to tank 12, via inlet 25 (FIG. 1), is provided by a further nylon fitting 65 (FIG. 2) that has a hose coupling 71 to afford a convenient connection to part of line 24 that extends to the reservoir or tank. If bypass line 33 is separate from return line 24 a second plug, like plug 64, may be used to close off the port of fitting 52 indicated as having a connection from process 11.

All of the fittings 51, 52, 55, 62, 64 and 65 are molded from nylon or other appropriate non-ionizing resin. The tubular connections 53 and 68 may be cut from tubing made of a non-ionizing resin such as PVC. There are just two stainless steel members, connector 61 and orifice member 54. There are no valves needed in the bypass line, regardless of whether that line is connected to the return conduit from industrial process 11 or has a separate connection to tank 12. The orifice 72 in the stainless steel orifice member 54 (see FIG. 3), may have an area of about 0.009 square inches (0.06 $cm^2$) to afford the flow characteristics of Table A. However, the orifice size may be varied to satisfy design requirements for different bypass flow rates relative to differential supply/return pressures.

Figure 4:
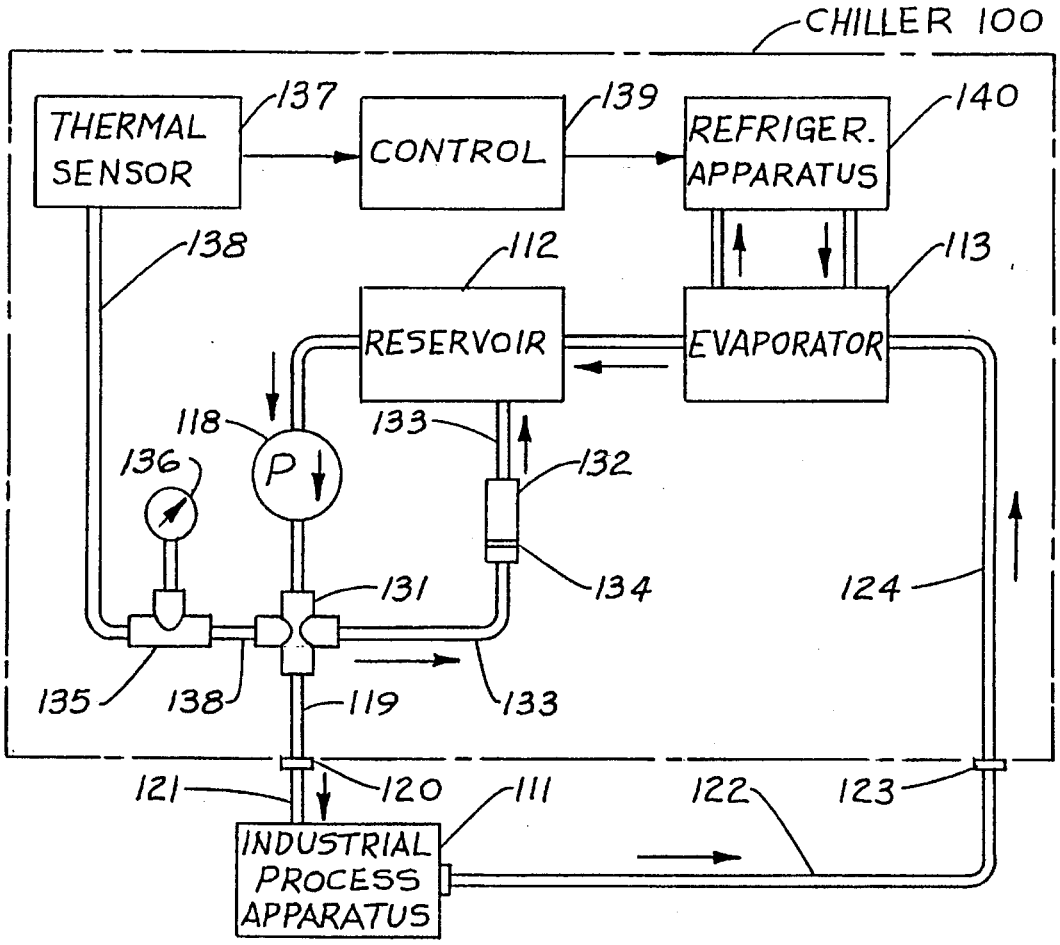
FIG. 4 is a schematic diagram, like FIG. 1 but showing another type of water chiller incorporating the improvement of the invention.

FIG. 4 illustrates a water chiller 100 which, like the chiller of FIG. 1, incorporates the improved bypass of the present invention. Chiller 100 is employed in conjunction with an industrial process apparatus 111. Industrial process apparatus 111, as before, may comprise EDM equipment, laser apparatus, or a conventional injection molding machine. Alternatively, apparatus 111 could equally well include any industrial process apparatus which requires a supply of chilled water or other liquid coolant. Chiller 100 includes an evaporator 113 connected to a reservoir 112 which is in turn connected to a pump 118 that supplies liquid coolant through a line 119 and a fitting 120 to a line 121 that leads to an industrial process apparatus 111. The return for the chilling liquid comprises a return line 122 from apparatus 111 to a connection 123 that is a part of chiller 100. A return line 124 in the chiller extends from connection 123 back to the chilling apparatus, specifically to evaporator 113.

As before, a special tee fitting 131 is interposed in series in line 119 in chiller 100. One branch of fitting 131 is connected by a line 138 to a thermal sensor 137. A fitting 135 is shown in series in line 138 and affords a connection to a pressure gauge 136. Another outlet of fitting 131 is connected to a bypass line 133 that is returned to reservoir 112. A fitting 132 provides a mount for an orifice member 134 in series in bypass line 133.

In the upper portion of chiller 100, as illustrated in FIG. 4, there is a control 139 that receives an electrical input from thermal sensor 137 and that supplies a control signal to a refrigeration apparatus 140. The refrigeration apparatus 140 is connected to evaporator 113 and is utilized to cool the liquid coolant supplied from evaporator 113 to reservoir 112. It will be recognized by those skilled in the art that chiller 100, illustrated in FIG. 4, is an example of a gravity dependent system employed in a commercial type of chiller apparatus, except, of course, for the described construction and the orifice member 134 in series in bypass line 133. Further, it will be recognized that chiller circuits other than those of FIGS. 1 and 4 can utilize the bypass of the present invention.

There is little point in describing the operation of chiller 110, FIG. 4, because in most respects it is essentially similar to that of the chiller 10 described in detail above in conjunction with FIG. 1. The princpal difference is that in the chiller construction of FIG. 4 the liquid coolant is supplied from the reservoir to the industrial process apparatus 111 instead of having that coolant supplied to the process apparatus from the evaporator. Bypass line 133 still establishes a bypass flow in parallel with industrial process apparatus 111, to the same effect and with the same advantages as discussed above in relation to FIG. 1. As before, there is no valve in the bypass line; the errors prevalent with prior art bypass constructions utilizing valves are effectively eliminated.

I claim:

1. An improvement in a chiller for a liquid coolant, the chiller comprising a reservoir for storing a liquid coolant, chilling apparatus including an evaporator connected to the reservoir, a supply line connection connectable to a process apparatus that requires an uncontaminated liquid coolant of consistent conductivity to supply chilled liquid coolant to the process apparatus, a return line connection connectable to the process apparatus for returning liquid coolant to the chiller, and a bypass line that affords a bypass flow of liquid coolant in the chiller, in parallel with the process apparatus, the improvement comprising:

a first fitting in series in the coolant supply line of the chiller, which fitting connects the supply line to the bypass line;

and a flow-limiting orifice member, interposed in series in the bypass line to limit the bypass flow to a given flow rate, there being no valve in the bypass line;

the orifice member being formed of a material that does not alter the conductivity of the coolant or contaminate the coolant.

2. An improvement in a chiller, according to claim 1, in which the liquid coolant is water.

3. An improvement in a chiller, according to claim 2, in which the liquid coolant is de-ionized water.

4. An improvement in a chiller, according to claim 1, in which the first fitting is a special tee fitting formed of a non-ionizing resin.

5. An improvement in a chiller, according to claim 1, in which:

the orifice member is mounted in a second fitting connected in series in the bypass line; and the second fitting is formed of a non-ionizing resin.

6. An improvement in a chiller, according to claim 1, in which the orifice member is formed of stainless steel.

7. An improvement in a chiller, according to claim 6, in which:

the liquid coolant is de-ionized water;

the orifice member is mounted in a second fitting connected in the bypass line; and the first and second fittings are each formed of a non-ionizing resin.

8. An improvement in a chiller, according to claim 7, in which the non-ionizing resin for the fittings is nylon.

9. An improvement in a chiller, according to claim 7, in which the orifice member is of stainless steel and has an orifice with an area of about 0.009 square inches (0.06 $cm^2$).

* * * * *